US011432634B2

(12) United States Patent
Silva

(10) Patent No.: US 11,432,634 B2
(45) Date of Patent: Sep. 6, 2022

(54) CONTAINER FOR COSMETIC SPONGE APPLICATOR

(71) Applicant: REA.DEEMING BEAUTY, INC., Bethlehem, PA (US)

(72) Inventor: Rea Ann Silva, Bethlehem, PA (US)

(73) Assignee: REA.DEEMING BEAUTY, INC., Bethlehem, PA (US)

( * ) Notice: Subject to any disclaimer, the term of this patent is extended or adjusted under 35 U.S.C. 154(b) by 297 days.

(21) Appl. No.: 16/271,756

(22) Filed: Feb. 8, 2019

(65) Prior Publication Data

US 2020/0046103 A1 Feb. 13, 2020

Related U.S. Application Data

(63) Continuation-in-part of application No. 29/659,262, filed on Aug. 7, 2018, now Pat. No. Des. 866,864.

(51) Int. Cl.

| | |
|---|---|
| ***A45D 33/26*** | (2006.01) |
| ***A45D 34/00*** | (2006.01) |
| ***A45D 40/00*** | (2006.01) |
| ***A45D 34/04*** | (2006.01) |
| ***A45D 40/26*** | (2006.01) |

(52) U.S. Cl.

CPC ..... *A45D 34/04* (2013.01); *A45D 33/26* (2013.01); *A45D 40/26* (2013.01); *A45D 2034/002* (2013.01); *A45D 2040/0006* (2013.01); *A45D 2200/05* (2013.01); *A45D 2200/1009* (2013.01)

(58) Field of Classification Search

CPC ..... A45D 34/04; A45D 34/00; A45D 33/006; A45D 44/18; A45D 40/00; A45D 33/26; A61C 19/02; A45C 5/005; A45C 11/008

USPC ..... 206/581

See application file for complete search history.

(56) References Cited

U.S. PATENT DOCUMENTS

| | | | |
|---|---|---|---|
| 558,535 | A | 4/1896 | Vivian |
| 1,247,906 | A | 11/1917 | Tully |
| 1,380,208 | A | 5/1921 | Holtschneider |
| 1,589,215 | A | 6/1926 | Forest |
| 1,732,028 | A | 10/1929 | Reiner |

(Continued)

FOREIGN PATENT DOCUMENTS

| | | |
|---|---|---|
| CH | 684574 | 10/1994 |
| CN | 201001673 | 1/2008 |

(Continued)

OTHER PUBLICATIONS

Beautylish, How should I store my beautyblender?, Sep. 8, 2014, https://www.beautylish.com/t/yuamrw/how-should-i-store-my-beautyblender.

*Primary Examiner* — Rafael A Ortiz

(74) *Attorney, Agent, or Firm* — Concept IP LLP; Pejman Yedidsion

(57) ABSTRACT

A container including: a first portion having an open end and a closed end, where the open end is disposed distal from the closed end; one or more first portion apertures disposed in the first portion to allow air flow into the container; a second portion having an open end and a closed end, where the open end is disposed distal from the closed end; one or more second portion apertures disposed in the second portion to allow air flow into the container; where an outer surface of the second portion is received by an inner surface of the first portion; and where the first portion is detachably attached to the second portion.

20 Claims, 14 Drawing Sheets

(56) References Cited

U.S. PATENT DOCUMENTS

| | | | |
|---|---|---|---|
| 2,247,600 | A | 7/1941 | Brennan et al. |
| 2,255,503 | A | 9/1941 | Carbary |
| 2,438,129 | A | 3/1948 | Richard |
| 2,555,047 | A | 5/1951 | Floyd |
| 2,620,085 | A | 12/1952 | Baldanza |
| 2,657,090 | A | 10/1953 | Meek |
| 2,708,595 | A | 5/1955 | Carl |
| 2,738,225 | A | 3/1956 | Meek |
| 2,765,194 | A | 10/1956 | Theodore |
| 2,769,565 | A | 11/1956 | John |
| 2,783,084 | A | 2/1957 | Worthen |
| 2,836,462 | A | 5/1958 | Wenner |
| 2,878,060 | A | 3/1959 | Dello |
| 2,958,469 | A | 11/1960 | Shuster |
| 3,686,788 | A | 8/1972 | Braunhut |
| 3,754,707 | A | 8/1973 | Morane |
| 3,848,803 | A | 11/1974 | Levey |
| 4,033,650 | A | 7/1977 | Alissandratos |
| 4,084,732 | A | 4/1978 | Dearling |
| 4,258,874 | A | 3/1981 | Webinger et al. |
| 4,293,095 | A | 10/1981 | Hamilton et al. |
| 4,306,679 | A | 12/1981 | Dusek et al. |
| 4,323,193 | A | 4/1982 | Compton et al. |
| 4,345,512 | A | 8/1982 | Moore |
| 4,502,630 | A | 3/1985 | Haworth et al. |
| 4,532,719 | A | 8/1985 | Davies et al. |
| 4,532,722 | A | 8/1985 | Sax |
| D280,757 | S | 9/1985 | Paulovich et al. |
| 4,545,917 | A | 10/1985 | Smith et al. |
| 4,549,693 | A | 10/1985 | Barlics |
| 4,567,675 | A | 2/1986 | Rennie |
| 4,696,317 | A | 9/1987 | Shioi et al. |
| 4,739,928 | A | 4/1988 | O'Neil |
| D317,044 | S | 5/1991 | Thomson |
| 5,033,674 | A | 7/1991 | Smith |
| 5,163,616 | A | 11/1992 | Bernarducci et al. |
| 5,314,669 | A | 5/1994 | Hamilton |
| D357,531 | S | 4/1995 | Weick |
| 5,437,410 | A | 8/1995 | Babasade |
| 5,526,966 | A | 6/1996 | Lutzker |
| 5,690,275 | A | 11/1997 | Bose et al. |
| 5,768,917 | A | 6/1998 | Freida |
| 6,032,495 | A | 3/2000 | Leu |
| 6,174,577 | B1 | 1/2001 | Vitorino |
| 6,186,324 | B1 | 2/2001 | Catterson |
| 6,245,230 | B1 | 6/2001 | Ricci |
| 6,338,406 | B1 | 1/2002 | Zagar |
| 6,363,947 | B1 | 4/2002 | Wu |
| 6,457,583 | B1 | 10/2002 | Tee et al. |
| D478,973 | S | 8/2003 | Wagner |
| D509,890 | S | 9/2005 | Stavale et al. |
| D509,894 | S | 9/2005 | Hoyt et al. |
| 6,966,500 | B1 | 11/2005 | Kelley |
| 7,350,720 | B2 | 4/2008 | Jaworski et al. |
| 7,360,650 | B2 | 4/2008 | Hoffecker |
| D579,163 | S | 10/2008 | Schablinger |
| D584,391 | S | 1/2009 | Howlett et al. |
| D617,439 | S | 6/2010 | Valentino et al. |
| D639,922 | S | 6/2011 | Howlett et al. |
| 8,240,503 | B2 | 8/2012 | Curtin |
| 8,251,299 | B1 | 8/2012 | Irvin |
| 8,523,020 | B2 | 9/2013 | Abfall et al. |
| 8,550,290 | B1 | 10/2013 | Davis |
| 8,671,499 | B2 | 3/2014 | Lim et al. |
| 9,138,044 | B2 | 9/2015 | Lim et al. |
| 9,220,391 | B1 | 12/2015 | Henninger |
| 9,228,289 | B2 | 1/2016 | Oh |
| 9,440,186 | B2 | 9/2016 | Wasson |
| 10,510,335 | B2 | 12/2019 | Lazar et al. |
| 2005/0173277 | A1 | 8/2005 | Rich |
| 2005/0268935 | A1 | 12/2005 | Hoffecker |
| 2006/0101707 | A1 | 5/2006 | James |
| 2007/0001025 | A1 | 1/2007 | Caserta et al. |
| 2007/0021783 | A1 | 1/2007 | Viana et al. |
| 2007/0181455 | A1 | 8/2007 | Davis |
| 2008/0318308 | A1 | 12/2008 | Hinchey |
| 2009/0165327 | A1 | 7/2009 | Nekovar |
| 2010/0003175 | A1 | 1/2010 | Gibson |
| 2010/0281928 | A1 | 11/2010 | Martin |
| 2011/0180543 | A1 | 7/2011 | Rusnak et al. |
| 2011/0284531 | A1 | 11/2011 | Chen |
| 2012/0091221 | A1 | 4/2012 | Levake et al. |
| 2012/0104113 | A1 | 5/2012 | Abfall et al. |
| 2013/0015089 | A1* | 1/2013 | McLaughlin ..... A45D 40/00 206/385 |
| 2013/0186816 | A1 | 7/2013 | Kepner et al. |
| 2014/0013501 | A1 | 1/2014 | Murphy et al. |
| 2014/0154153 | A1 | 6/2014 | Averdam et al. |
| 2015/0272416 | A1 | 10/2015 | Lu |
| 2015/0335132 | A1* | 11/2015 | Hall ..... A45D 40/0075 222/146.5 |
| 2016/0000958 | A1 | 1/2016 | Matias |
| 2016/0278588 | A1 | 9/2016 | Caldwell et al. |
| 2016/0302389 | A1 | 10/2016 | Christensen |
| 2017/0102183 | A1* | 4/2017 | Palmer ..... F26B 21/12 |
| 2018/0027947 | A1* | 2/2018 | Quennessen ..... A45D 40/24 |
| 2018/0050839 | A1* | 2/2018 | Cibotariu ..... A45D 34/02 |
| 2018/0168333 | A1 | 6/2018 | Zeilah |

FOREIGN PATENT DOCUMENTS

| | | | |
|---|---|---|---|
| CN | 201801065 | U | 4/2011 |
| CN | 102665485 | A | 9/2012 |
| CN | 102665485 | B | 6/2015 |
| CN | 204507583 | U | 7/2015 |
| CN | 305674976 | | 4/2020 |
| DE | 2322360 | A1 | 11/1973 |
| FR | 1596401 | A | 6/1970 |
| FR | 2231216 | | 12/1974 |
| FR | 2833531 | A1 | 6/2003 |
| FR | 2833531 | B1 | 6/2004 |
| GB | 191304814 | A | 4/1913 |
| JP | H09341 | U | 6/1997 |
| JP | 2005143736 | A | 6/2005 |
| JP | 2012035257 | A | 2/2012 |
| JP | 2016527972 | A | 9/2016 |
| KR | 20130095531 | A | 8/2013 |
| KR | 20160025871 | A | 3/2016 |
| KR | 20160059377 | A | 5/2016 |
| KR | 20160002585 | U | 7/2016 |
| KR | 101678822 | B1 | 11/2016 |
| KR | 200484247 | Y1 | 8/2017 |
| TW | M493302 | U | 1/2015 |
| TW | M493302 | U | 1/2015 |
| WO | 2003008000 | A1 | 1/2003 |
| WO | 2003070287 | A1 | 8/2003 |
| WO | 2003101499 | A1 | 12/2003 |
| WO | 2007048178 | A1 | 5/2007 |

* cited by examiner

CONTAINER FOR COSMETIC SPONGE APPLICATOR

CROSS-REFERENCE TO RELATED APPLICATIONS

This application is a continuation-in-part of U.S. Design patent application Ser. No. 29/659,262 filed Aug. 7, 2018, the contents of which, including all appendices, are hereby incorporated by reference herein for all purposes.

FIELD OF THE INVENTION

Embodiments relate generally to cosmetic tools, and more particularly to cosmetic holders.

BACKGROUND

Users may desire to take and carry their cosmetic sponge with them. However, cosmetic sponges can be delicate and may be damaged during travel, such as by being crushed in a bag or torn by an object with sharp edges. Cosmetic sponges may increase greatly in size when damp and take several hours to dry and return to their original size. As a result, storage options for dry cosmetic sponges may not accommodate dampened cosmetic sponges.

SUMMARY

A device embodiment may include: a container including: a first portion that may include an open end, a closed end, and a middle section, where the open end may be disposed distal from the closed end, where the closed end may have a rounded shape, where the middle section may be disposed between the open end and the closed end, and where the middle section may have a substantially constant cross-section; one or more first portion apertures disposed in the first portion proximate the closed end to allow air flow into the container; a second portion may include an open end, a closed end, and a middle section, where the open end may be disposed distal from the closed end, where the closed end may have a rounded shape, where the middle section may be disposed between the open end and the closed end, and where the middle section may have a substantially constant cross-section; and one or more second portion apertures disposed in the second portion proximate the closed end to allow air flow into the container; where an outer diameter of the open end of the second portion may be substantially the same as an inner diameter of the open end of the first portion; where an outer surface of the middle section of the second portion may be received by an inner surface of the middle section of the first portion; and where the first portion may be detachably attached to the second portion.

In additional embodiments, moving the first portion apart from the second portion may increase an overall height of the container; and moving the first portion towards from the second portion may decrease an overall height of the container. The height of the container may be adjustable based on a length of at least one of: the middle section of the first portion and the middle section of the second portion. The height of the container may be adjustable based on a friction fit between the middle section of the first portion and the middle section of the second portion.

The container may also include: first screw threads disposed on an outer surface of the first portion; and second screw threads disposed on an inner surface of the second portion; where the height of the container may be adjustable based on rotation of the first portion relative to the second portion as the first screw threads engage the second screw threads. The container may also include: one or more magnets disposed in at least one of: the middle section of the first portion and the middle section of the second portion; and one or more magnetic metals disposed in at least one of: the middle section of the first portion and the middle section of the second portion; where the height of the container may be adjustable based on securing the one or more magnets to the one or more magnetic metals.

In some embodiments, moving the first portion apart from the second portion may increase an overall volume of the container; and moving the first portion towards from the second portion may decrease an overall volume of the container. The volume of the container may be adjustable based on a length of at least one of: the middle section of the first portion and the middle section of the second portion. Additional embodiments may include: a weighted portion disposed in at least one of: the first portion and the second portion. The weighted portion may be disposed in at least one of: the closed end of the first portion and the closed end of the second portion, where the weighted portion may maintain the container in a generally upright position when placed on a surface. The weighted portion may be at least one of: a magnet and a magnetic metal. The container may be sized to fit one or more dampened cosmetic sponges. The one or more first portion apertures may further include: one or more larger sized apertures; and one or more smaller sized apertures; where the larger sized apertures are disposed farther from the closed end of the first portion than the smaller sized apertures.

An additional embodiment may include a container including: a first portion that may include an open end and a closed end, where the open end may be disposed distal from the closed end; one or more first portion apertures disposed in the first portion to allow air flow into the container; a second portion that may include an open end and a closed end, where the open end may be disposed distal from the closed end; and one or more second portion apertures disposed in the second portion to allow air flow into the container; where an outer surface of the second portion may be received by an inner surface of the first portion; and where the first portion may be detachably attached to the second portion.

In additional embodiments, the closed end of the first portion may have a rounded shape, and the closed end of the second portion may have a rounded shape. An outer diameter of the open end of the second portion may be substantially the same as an inner diameter of the open end of the first portion. The first portion may include a middle section having a substantially constant cross-section, and the second portion includes a middle section having a substantially constant cross-section. The first portion may be detachably attached to the second portion by at least one of: a friction fit, one or more screw threads, one or more magnets, and one or more magnetic metals.

BRIEF DESCRIPTION OF THE DRAWINGS

The components in the figures are not necessarily to scale, emphasis instead being placed upon illustrating the principals of the invention. Like reference numerals designate corresponding parts throughout the different views. Embodiments are illustrated by way of example and not limitation in the figures of the accompanying drawings, in which.

DETAILED DESCRIPTION

The disclosed system allows for a container to secure a cosmetic sponge or other similar cosmetic applicator tools and allow for drying of the cosmetic sponge without the sponge coming into contact with other items in the close proximity.

Figure 1B:
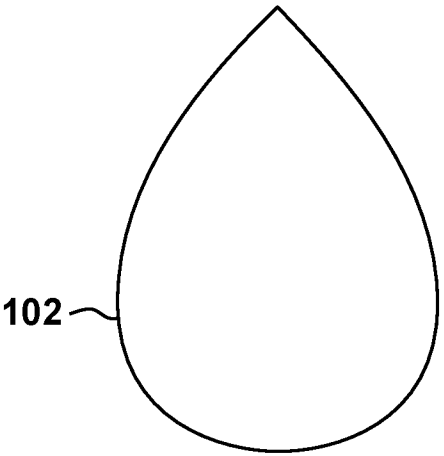
FIG. 1B depicts a dampened cosmetic sponge, according to one embodiment.
Figure 1A:
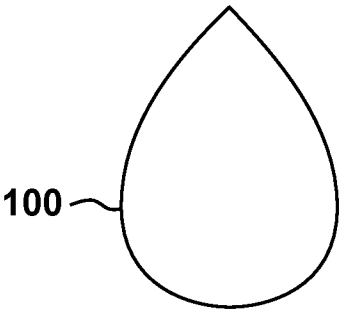
FIG. 1A depicts a dry cosmetic sponge, according to one embodiment.

FIG. 1A depicts a dry cosmetic sponge 100, according to one embodiment. The cosmetic sponge may have a general teardrop shape as shown, an oval shape, or a shape with any number of contours. The various angles of the cosmetic sponge 100 may make the cosmetic sponge 100 difficult to store. The various angles of the cosmetic sponge 100 also may make the cosmetic sponge 100 susceptible to rolling on a flat surface, such as a countertop. The material of the cosmetic sponge 100 may make the cosmetic sponge 100 susceptible to damage if stored with other objects, such as in a purse, handbag, or makeup container. Additionally, the cosmetic sponge may cause damage to other items by smearing makeup on them.

FIG. 1B depicts a dampened cosmetic sponge 102, according to one embodiment. The cosmetic sponge (100, FIG. 1A) may be dampened, such as with water, prior to use. Adding water to the cosmetic sponge (100, FIG. 1A) causes the dampened cosmetic sponge 102 to increase greatly in size. The dampened cosmetic sponge provides a greater surface area and absorption for applying makeup, foundation, or the like. Once the dampened cosmetic sponge 102 has been used for its intended purpose, it may remain at the larger size for several hours before drying and returning to its original size. As a result, the dampened cosmetic sponge 102 may not fit in an original packaging or space it fit in prior to use. Squishing the dampened cosmetic sponge 102 to fit in an original packaging or space may cause damage or the dampened cosmetic sponge 102 and/or reduce the lifetime of the dampened cosmetic sponge 102. Due to its increased size, the dampened cosmetic sponge 102 is more difficult to store and more susceptible to rolling on a flat surface than the dry cosmetic sponge 100.

Figure 2B:
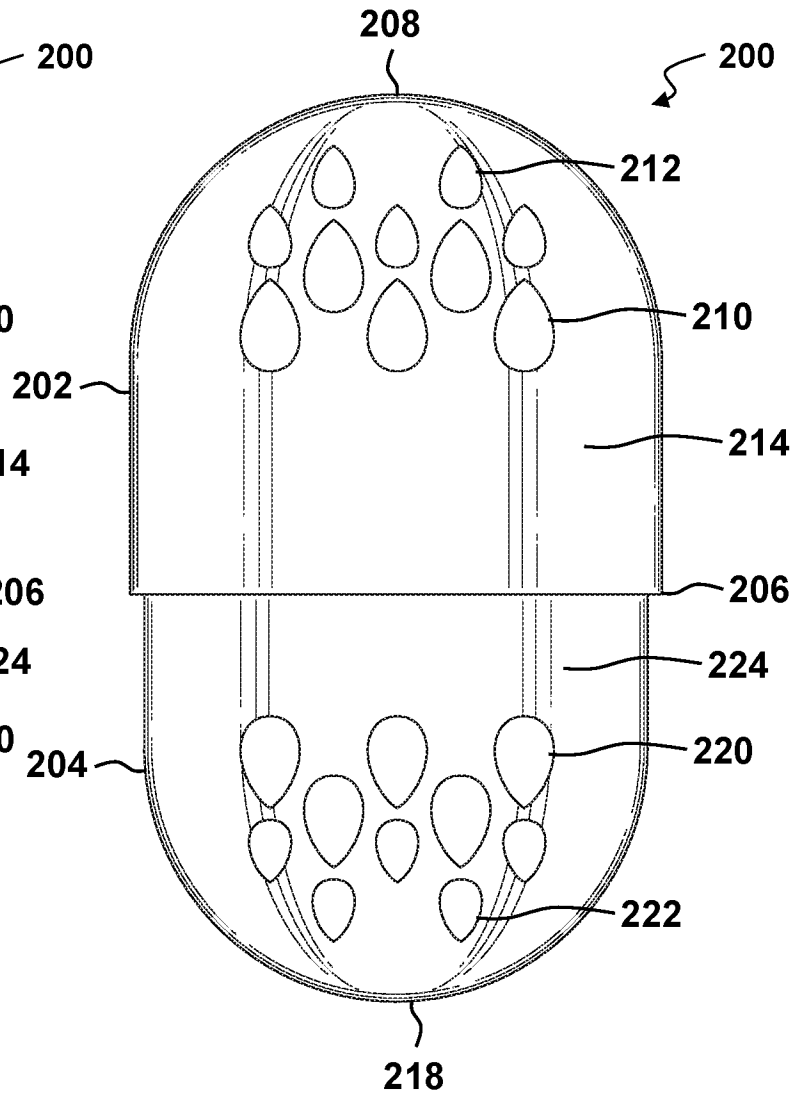
FIG. 2B depicts a rear view of the container of FIG. 2A, according to one embodiment.
Figure 2A:
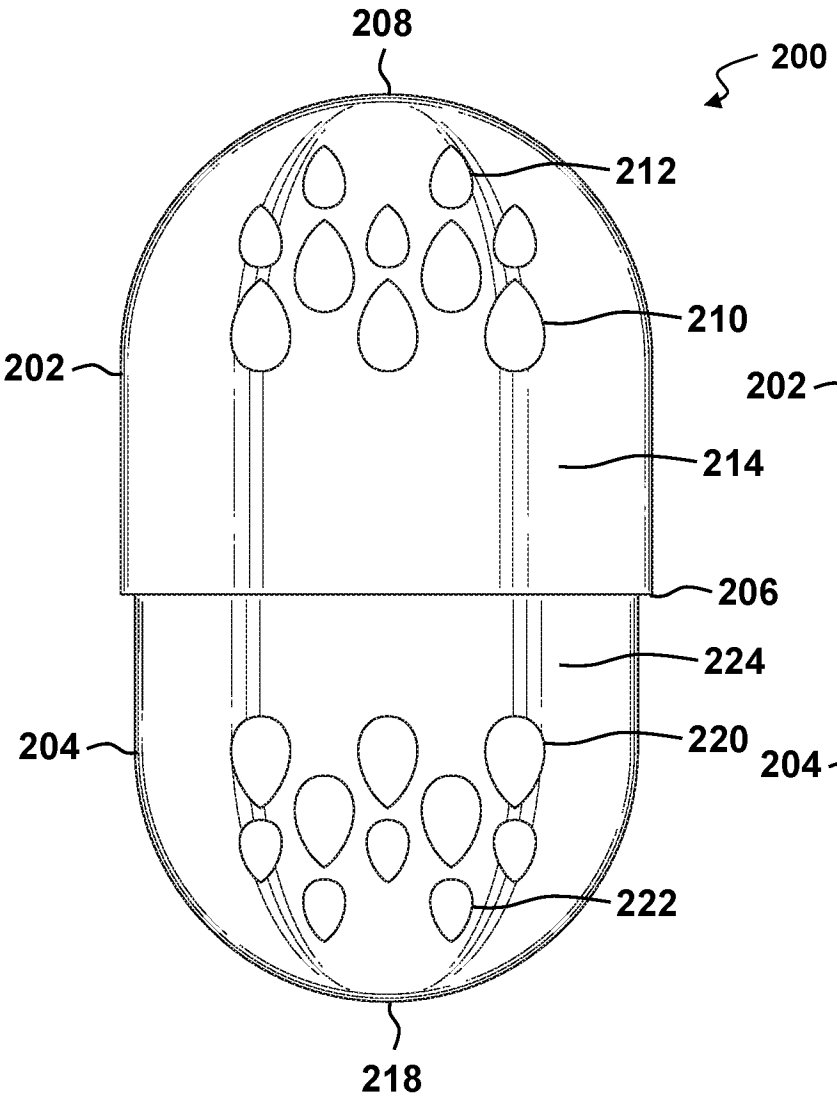
FIG. 2A depicts a front view of a container, according to one embodiment.
Figure 2D:
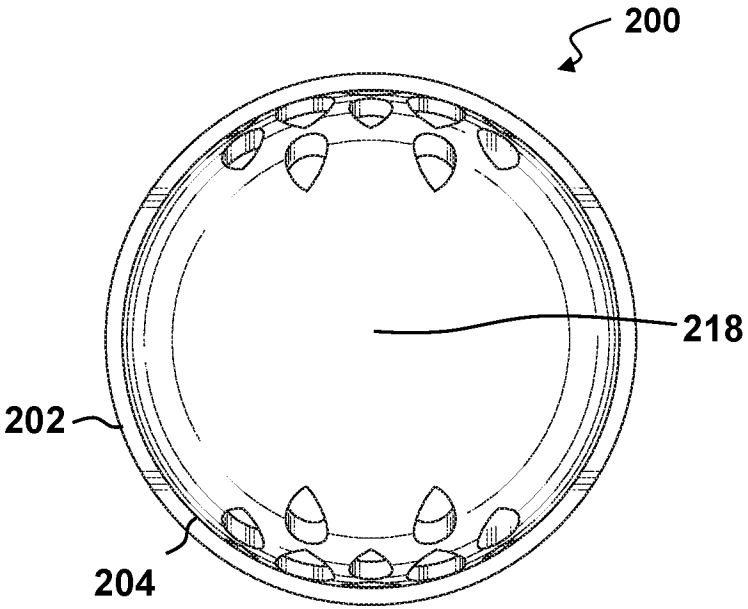
FIG. 2D depicts a bottom view of the container of FIG. 2A, according to one embodiment.
Figure 2C:
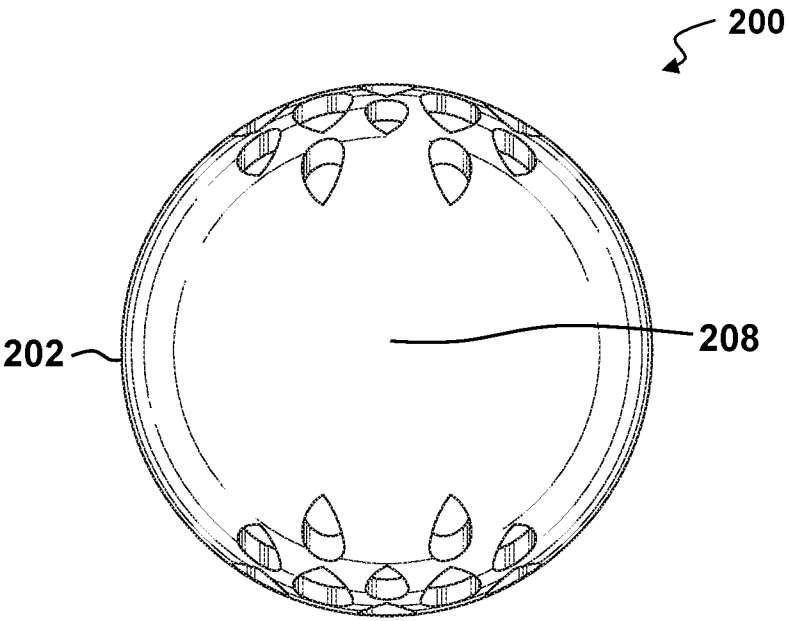
FIG. 2C depicts a top view of the container of FIG. 2A, according to one embodiment.
Figure 2F:
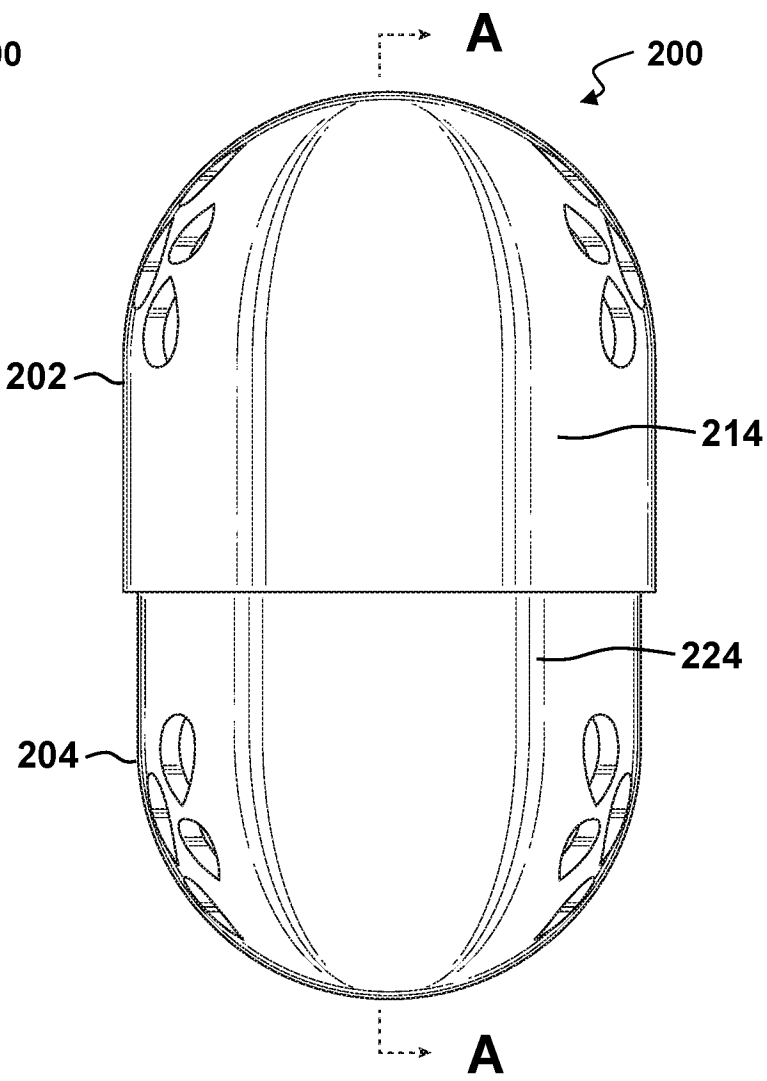
FIG. 2F depicts a right side view of the container of FIG. 2A, according to one embodiment.
Figure 2E:
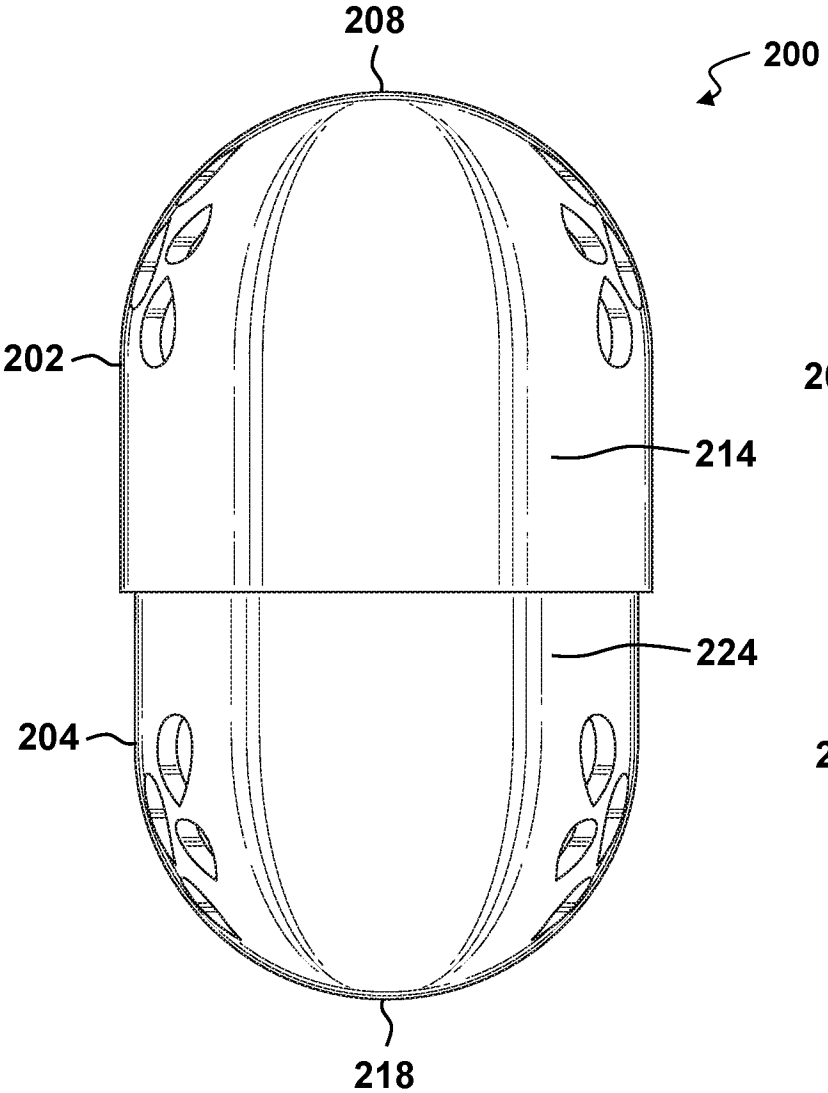
FIG. 2E depicts a left side view of the container of FIG. 2A, according to one embodiment.
Figure 2G:
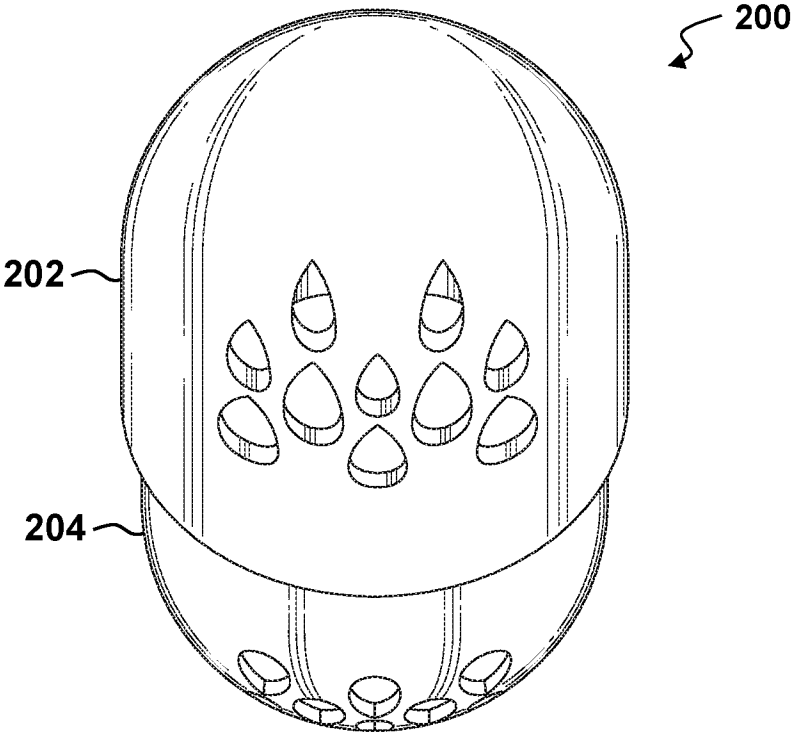
FIG. 2G depicts a perspective view of the container of FIG. 2A, according to one embodiment.
Figure 2H:
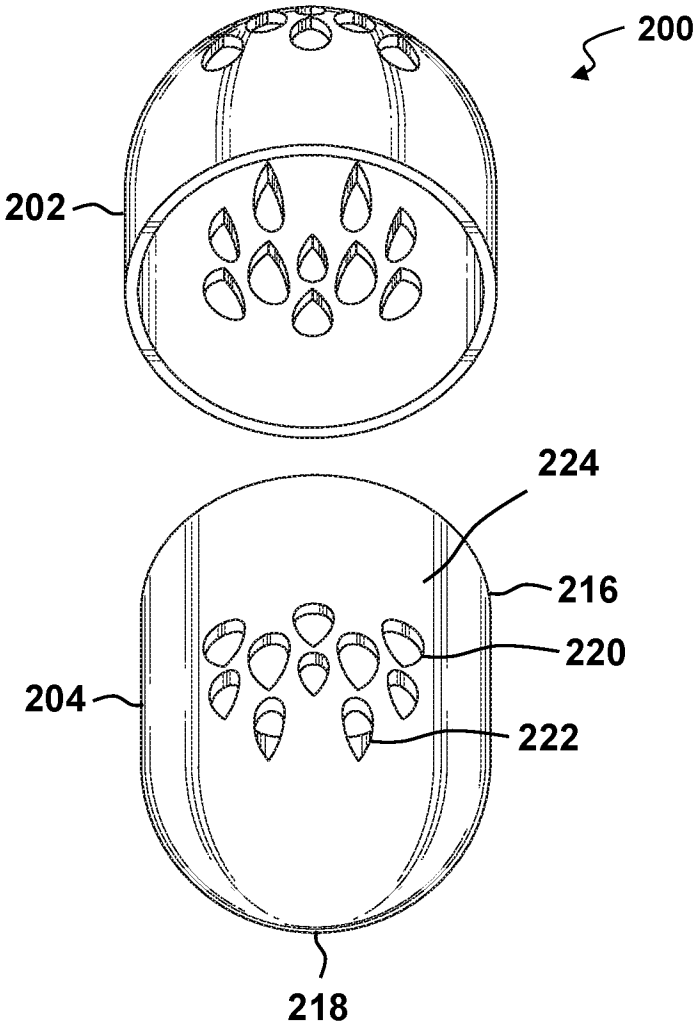
FIG. 2H depicts an exploded view of the container of FIG. 2A, according to one embodiment.

FIG. 2A depicts a front view of a container 200, according to one embodiment. FIG. 2B depicts a rear view of the container 200 of FIG. 2A, according to one embodiment. FIG. 2C depicts a top view of the container 200 of FIG. 2A, according to one embodiment. FIG. 2D depicts a bottom view of the container 200 of FIG. 2A, according to one embodiment. FIG. 2E depicts a left side view of the container 200 of FIG. 2A, according to one embodiment. FIG. 2F depicts a right side view of the container 200 of FIG. 2A, according to one embodiment. FIG. 2G depicts a perspective view of the container 200 of FIG. 2A, according to one embodiment. FIG. 2H depicts an exploded view of the container 200 of FIG. 2A, according to one embodiment.

The container 200 may include a first portion 202 and a second portion 204. The first portion 202 may be detachably attached to the second portion 204 via a friction or interference fit. The first portion 202 may include a closed end 208 and an open end 206. The open end 206 may be disposed distal from the closed end 208. The closed end 208 may have a rounded, domed, or arcuate shape. The open end 206 as shown may have a circular cross-section. In some embodiments, the cross-section of the open end 206 may be triangular, rectangular, or any other shape having a number of sides. The first portion 202 may include one or more apertures 210, 212 to allow air flow into and out of the container 200. The apertures 210, 212 may include larger sized apertures 210 and smaller sized apertures 212. The larger sized apertures 210 may be disposed farther from the closed end 208 than the smaller sized apertures 212. The apertures 210, 212 may be disposed proximate the closed end 208 of the first portion 202 to provide uninterrupted airflow when the first portion 202 is detachably attached to the second portion 204. A middle section 214 of the first portion 202 may be disposed between the open end 206 and the closed end 208. The middle section 214 of the first portion 202 may have a substantially constant cross-section for receiving a corresponding section of the second portion 204.

The second portion 204 may include an open end 216 and a closed end 218. The open end 216 may be disposed distal from the closed end 218. The closed end 218 may have a rounded, domed, or arcuate shape. The open end 216 as shown may have a circular cross-section. In some embodiments, the cross-section of the open end 216 may be triangular, rectangular, or any other shape having a number of sides. The second portion 204 may include one or more apertures 220, 222 to allow air flow into and out of the container 200. The apertures 220, 222 may include larger sized apertures 220 and smaller sized apertures 222. The apertures 220, 222 may be disposed proximate the closed end 218 of the second portion 204 to provide uninterrupted airflow when the first portion 202 is detachably attached to the second portion 204. A middle section 224 of the second portion 204 may be disposed between the open end 216 and the closed end 218. The middle section 224 of the second portion 204 may have a substantially constant cross-section for receiving a corresponding section of the first portion 202.

In one embodiment, the container 200 may function as a travel case made out of flexible and shatter proof material, thereby allowing ease of use, storage, and carrying of the container 200. In some embodiments, the container 200 may be made out of silicone which may be heat-resistant and rubber-like material. In some examples, the silicon material is silicone rubber which is an elastomer composed of silicone—itself a polymer—and provides a low-taint, non-toxic material for coming into contact with the skin and/or cosmetic applicators. According to the disclosed embodiments, the container 200 may be squeezable and adjustable in size and volume while maintaining an overall shape to store multiple cosmetic applicators and provide protection to them. In addition, the apertures disposed along the surface of the first portion 202 and the surface of the second portion 204 provide breathing holes to prevent mold as the ventilated design allows the cosmetic applicators to breathe while air-drying. The apertures disposed along the surface may be in any shape, for example, circle, tear drop, folium, egg, heart, etc. The apertures may be placed across from each other at opposite ends of the first portion or second portions, in parallel so as to provide unobstructed airflow and make possible minimum time needed to air-dry the contents inside.

Figure 3:
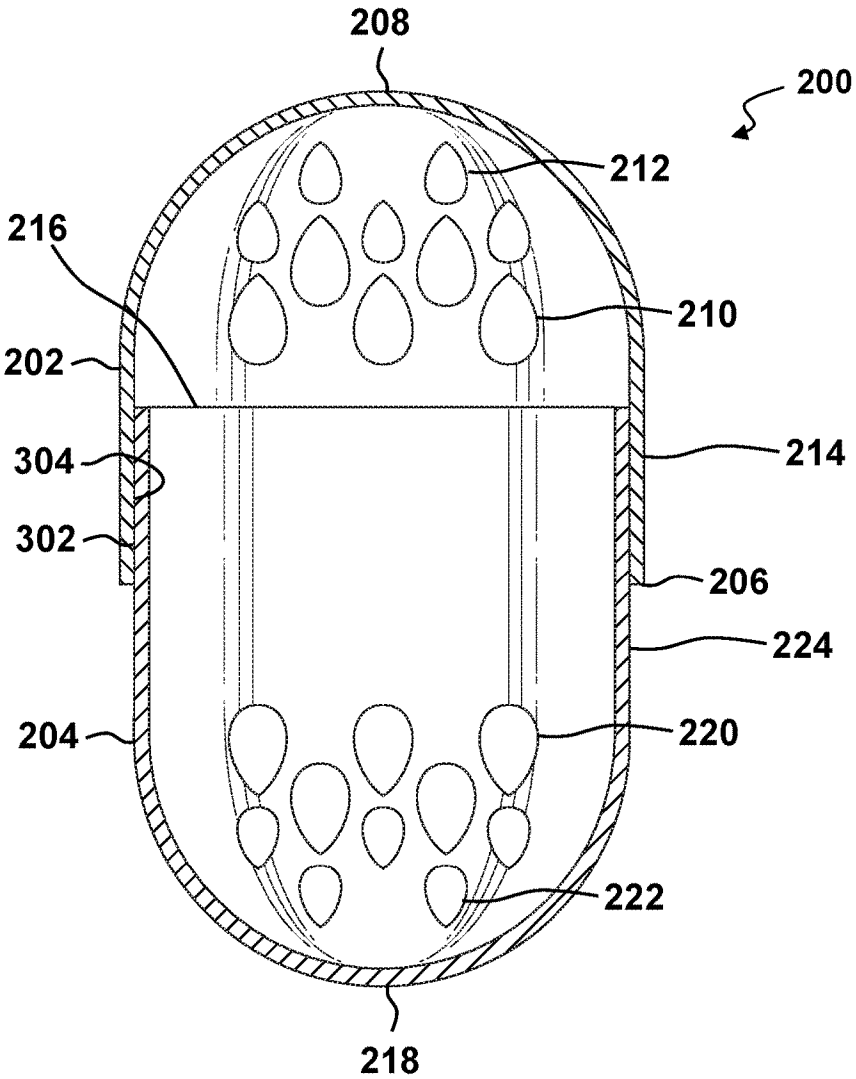
FIG. 3 depicts a cross-sectional view of the container of FIG. 2F about line A-A, according to one embodiment.

FIG. 3 depicts a cross-sectional view of the container of FIG. 2F about line A-A, according to one embodiment. The outer diameter of the open end 216 of the second portion 204 may be substantially the same as the inner diameter of the open end 206 of the first portion 202 such that the outer surface 302 of the middle section 224 of the second portion 204 may be slidably received by the inner surface 304 of the middle section 214 of the first portion 202. In some embodiments, the outer diameter of the open end 216 of the second portion 204 may be slightly larger than the inner diameter of the open end 206 of the first portion 202 to ensure a tight fit. The material of the first portion 202 and the second portion 204 of the container 200 may be resilient, such as a flexible plastic, rubber, or the like to allow for some deformation. In other embodiments, the material of the first portion 202 and the second portion 204 of the container 200 may be inflexible, such as a hard plastic, metal, or the like. When the first portion 202 and the second portion 204 are detachably attached, the container may resemble the shape of a capsule with adjustable sides.

Figure 4B:
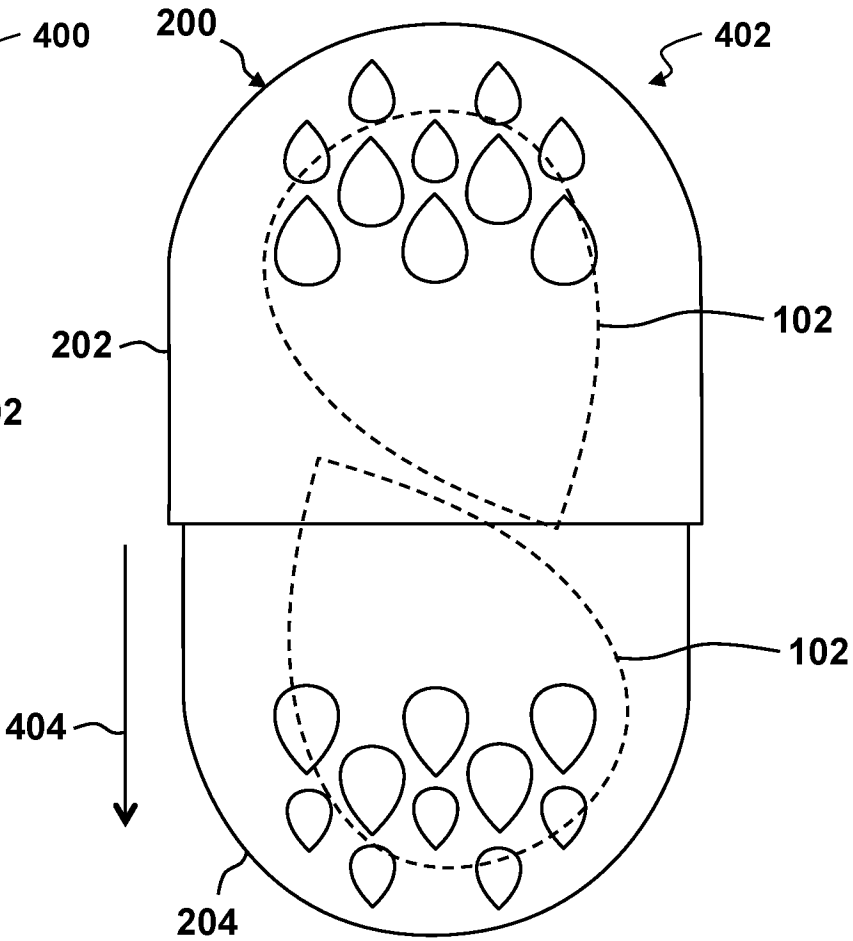
FIG. 4B depicts the container of FIG. 4B in a second closed position with two cosmetic sponges shown in dashed lines, according to one embodiment.
Figure 4A:
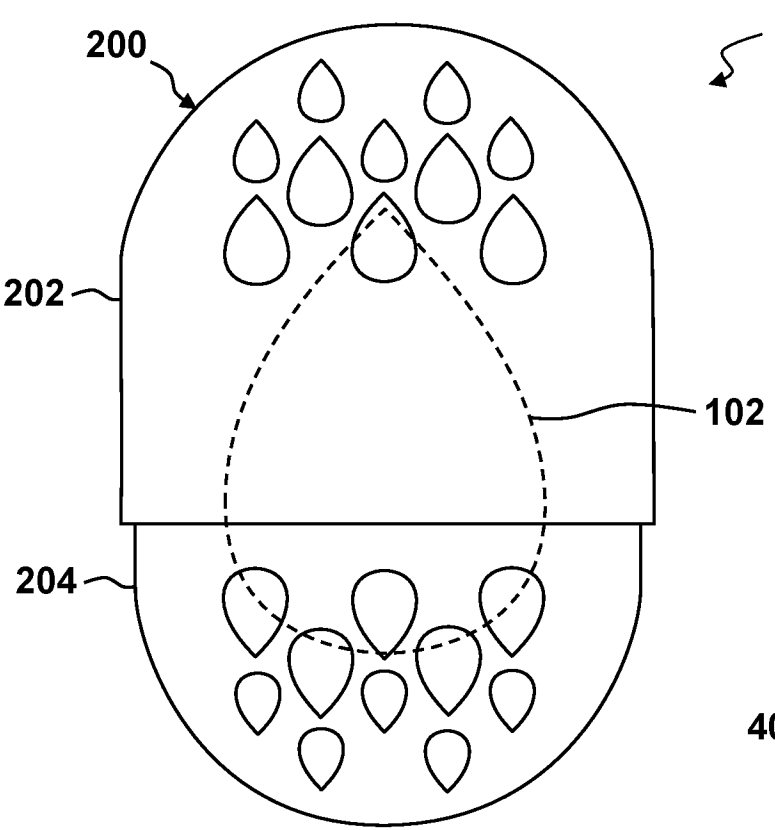
FIG. 4A depicts a container in a first closed position with a cosmetic sponge shown in dashed lines, according to one embodiment.

FIG. 4A depicts a container 200 in a first closed position 400 with a cosmetic sponge 102 shown in dashed lines, according to one embodiment. The first portion 202 and the second portion 204 of the container 200 may be closed in the first position 400 so as to provide space within the container 200 for a single cosmetic sponge 102 that may be dampened. The space inside the container 200 and vents allow for airflow so that the dampened cosmetic sponge 102 can air-dry. As the cosmetic sponge 102 dries, it may shrink in size, as shown in FIG. 1A.

FIG. 4B depicts the container 200 of FIG. 4B in a second closed position 402 with two cosmetic sponges 102 shown in dashed lines, according to one embodiment. The first portion 202 and the second portion 204 of the container 200 may be pulled apart 404 into the second position 402 so as to provide space within the container 200 for two cosmetic sponges 102, that may each be dampened. The space inside the container 200 and vents allow for airflow so that the dampened cosmetic sponges 102 can air-dry. As each cosmetic sponge 102 dries, it shrinks in size, as shown in FIG. 1A. In some embodiments, the size and shape of the container 200 may be modified to fit one or more dampened cosmetic sponges 102. The container may be expanded 404 or pushed together, as in FIG. 4A, to accommodate a varying number of cosmetic sponges 102. The first portion 202 may be pushed towards and/or pulled apart from the second portion 204 to increase or decrease, respectively, the height of the container 200 and a volume inside the container. The amount the container 200 may be expanded or contracted may be based on a length of the middle sections of the first portion 202 and second portion 204. A user may have multiple cosmetic sponges for each type of makeup, foundation, or the like. The user may also have cosmetic sponges of different sizes for differing applications or the like, which may be accommodated and stored within the container 200.

Figure 5:
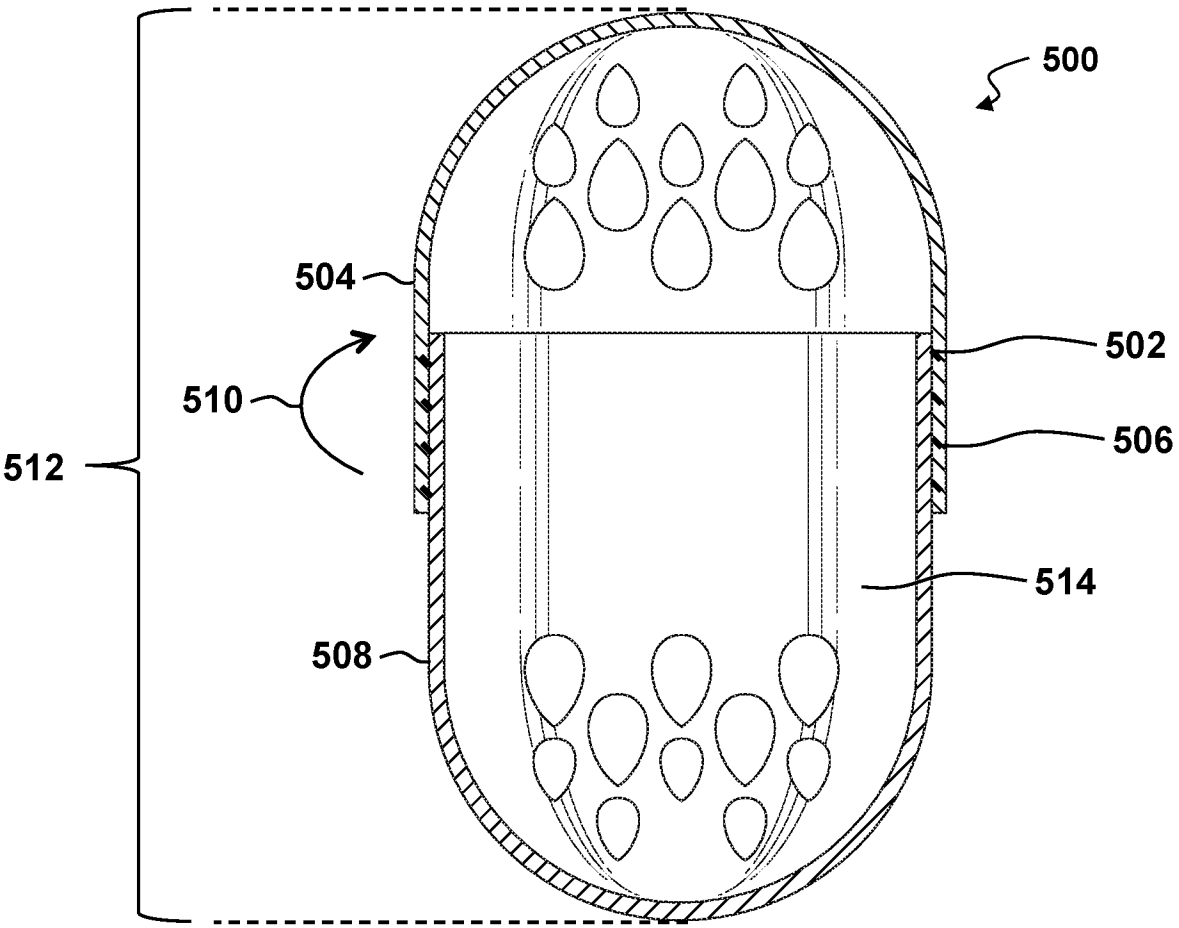
FIG. 5 depicts a cross-sectional view of an alternate container having screw threads, according to one embodiment.

FIG. 5 depicts a cross-sectional view of an alternate container 500 having screw threads 502, 506, according to one embodiment. A first portion 504 of the container 500 may have first screw threads 502. A second portion 508 of the container 500 may have second screw threads 506. The first screw threads 502 may engage the second screw threads 506 via a rotation 510 of the first portion 504 relative to the second portion 508. In one embodiment, the screw threads 502, 506 may allow for a closure of the first portion 504 relative to the second portion 508. In another embodiment, the user may select a variable number of rotations 510 to adjust an overall height 512 of the container 500, such as shown in FIGS. 4A-4B. Fewer rotations may result in a greater height 512 of the container and allow for additional cosmetic sponges to be stored inside the container 500. More rotations may result in a shorter height 512 of the container and allow for fewer cosmetic sponges to be stored inside the container 500. Increasing the overall height 512 increases an interior volume 514 of the container. Decreasing the overall height decreases an interior volume 514 of the container.

Figure 6:
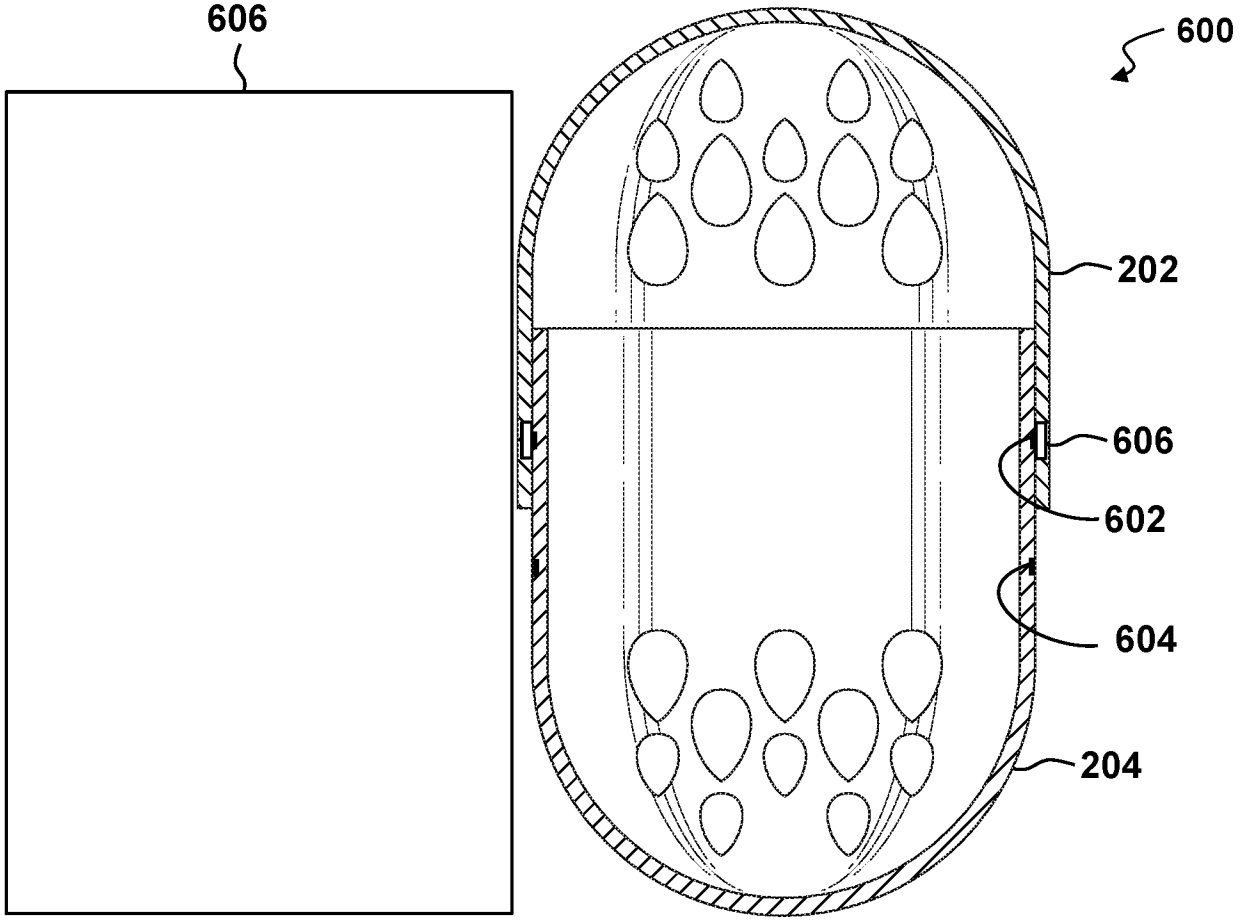
FIG. 6 depicts a cross-sectional view of an alternate container having magnets, according to one embodiment.

FIG. 6 depicts a cross-sectional view of an alternate container 600 having magnets 602, 604, according to one embodiment. The first portion 202 and/or second portion 204 may include one or more magnets 602, 604 and/or one or more magnetic metals 606. The magnets 602, 604 and/or metals 606 may be used to secure the first portion 202 and the second portion 204 together at one or more container 600 heights, such as shown in FIGS. 4A-4B. In some embodiments, the magnets 602, 604 may be used to secure the container 600 to an external surface 608, such as a mirror, makeup box, or the like. The magnets 602, 604 may keep the container 600 secured to the external surface 608 to avoid the container from rolling off a counter, getting lost, or damaged.

Figure 7:
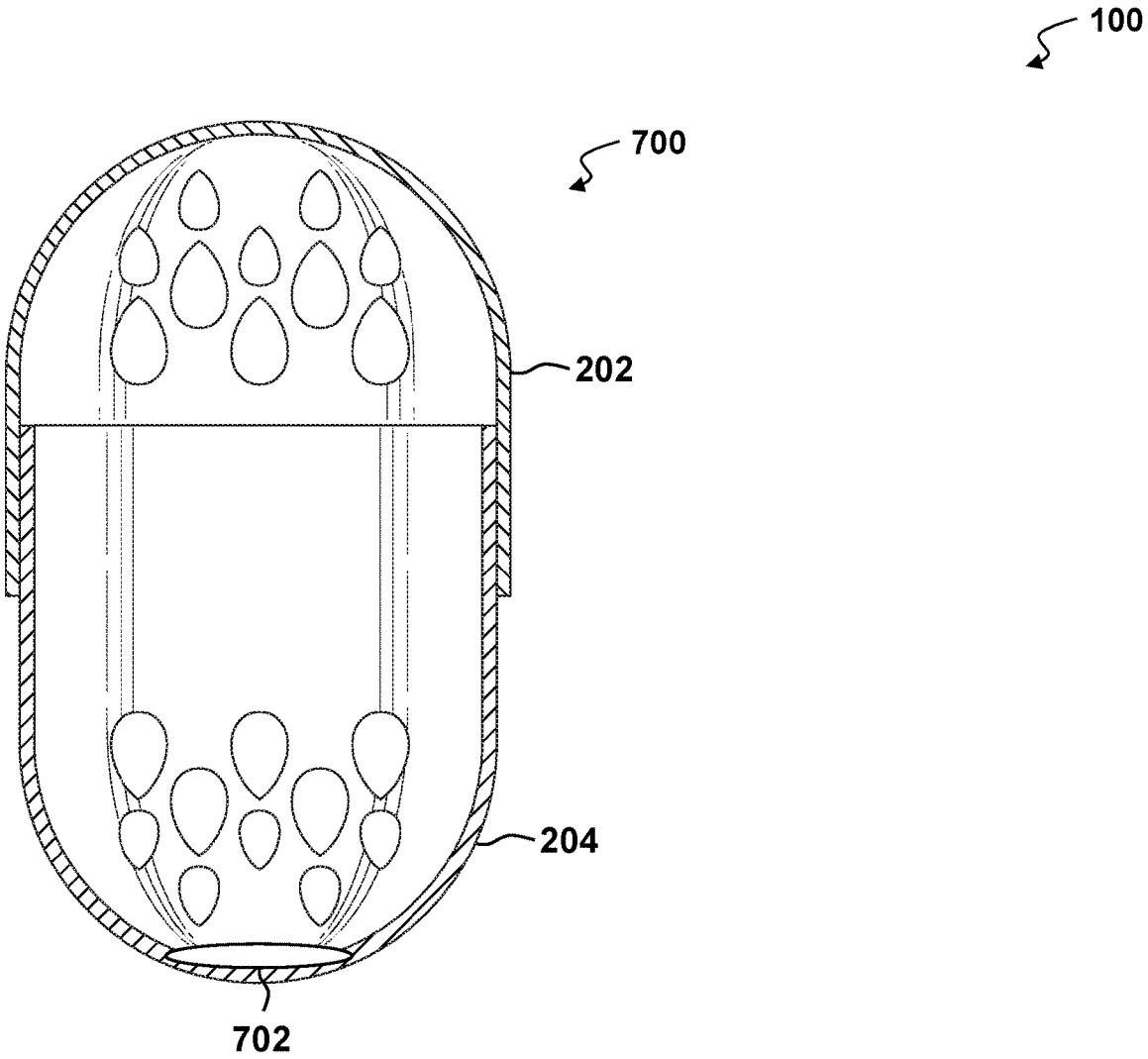
FIG. 7 depicts a cross-sectional view of an alternate container having a weighted portion, according to one embodiment.

FIG. 7 depicts a cross-sectional view of an alternate container 700 having a weighted portion 702, according to one embodiment. The first portion 202 and/or second portion 204 of the container 700 may contain a weighted portion 702 disposed on an end of the container. The weighted portion 702 may ensure that the container maintains a generally upright position when placed on a countertop or in a bag to avoid from having the container 700 roll off of a surface, get lost, or the like. While the weighted portion 702 is shown as disposed proximate the closed end of the second portion 204, the weighted portion 702 may be disposed anywhere in or on the container 700. In some embodiments, the weighted portion 702 may be a magnet or a magnetic metal.

Figures 8A, 8B:
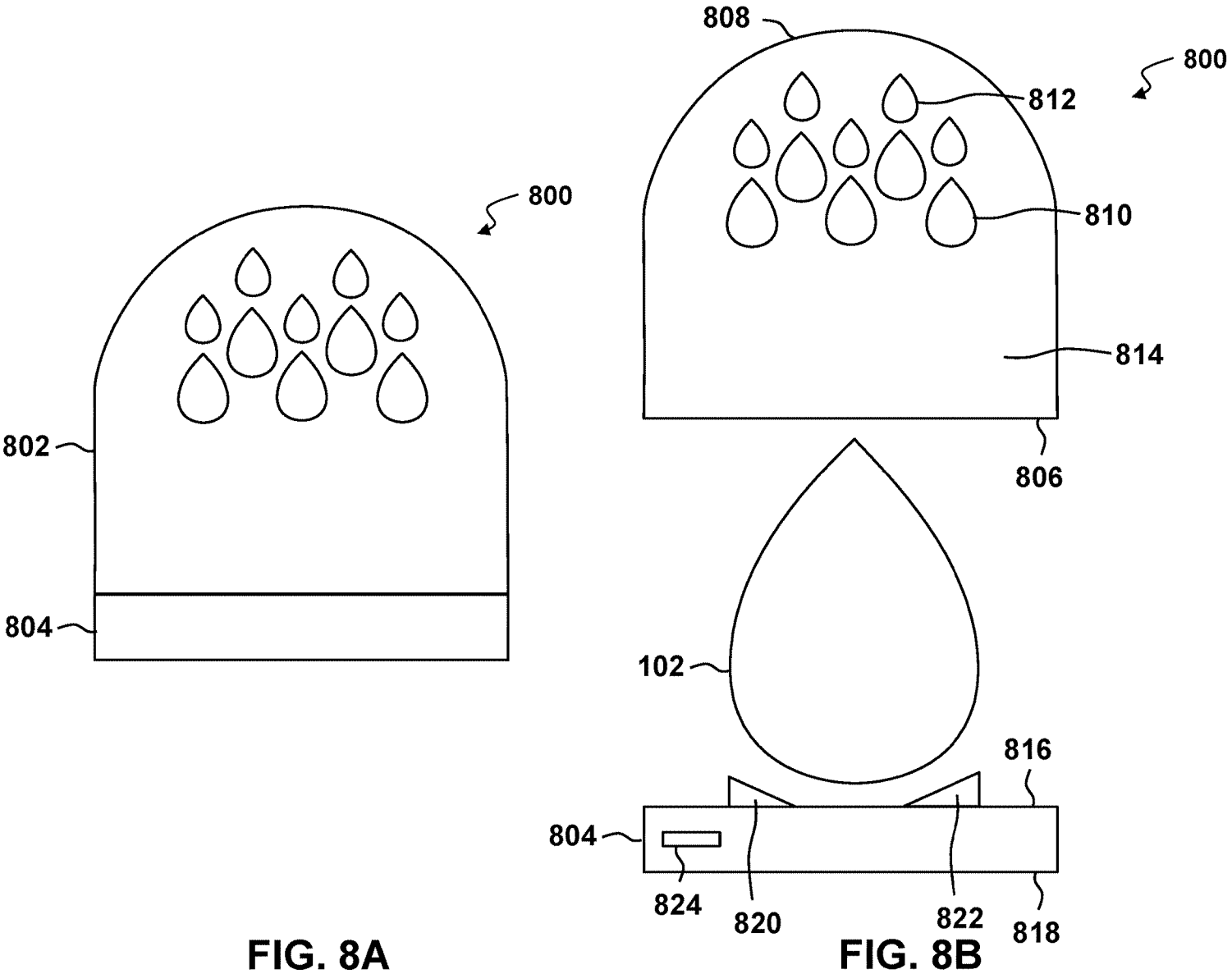
FIG. 8A depicts an alternate container having a flat bottom portion, according to one embodiment.
FIG. 8B depicts an exploded view of the alternate container 800 of FIG. 8A having a flat bottom portion, according to one embodiment. The container 800 may have a first portion 802 and a second portion 804.

FIG. 8A depicts an alternate container 800 having a flat bottom portion 804, according to one embodiment. FIG. 8B depicts an exploded view of the alternate container 800 of FIG. 8A having a flat bottom portion 804, according to one embodiment. The first portion 802 may include a closed end 808 and an open end 806. The open end 806 may be disposed distal from the closed end 808. The closed end 808 may have a rounded, domed, or arcuate shape. The open end 806 may have a circular cross-section. In some embodiments, the cross-section of the open end 806 may be triangular, rectangular, or any other shape having a number of sides. The first portion 802 may include one or more apertures 810, 812 to allow air flow into and out of the container 800. The apertures 810, 812 may include larger sized apertures 810 and smaller sized apertures 812. The apertures 810, 812 may be disposed proximate the closed end 808 of the first portion 802 to provide uninterrupted airflow when the first portion 802 is detachably attached to the second portion 804. A middle section 814 of the first portion 802 may be disposed between the open end 806 and the closed end 808. The middle section 214 of the first portion 202 may have a substantially constant cross-section.

The second portion 804 may include an upper surface 816 and a lower surface 818. The upper surface 816 may be disposed distal from the lower surface 818. The second portion 804 may have a circular cross-section. In some embodiments, the cross-section of the second portion 804 may be triangular, rectangular, or any other shape having a number of sides. The upper surface 816 may contain one or more guides 820, 822 for receiving the cosmetic sponge 102, where in some cases may be dampened. The guides 820, 822 may position the dampened cosmetic sponge 102 within the container 800 such that airflow may dry out a maximum surface area of the dampened cosmetic sponge 102. In some embodiments, the second portion 804 may include one or more apertures 824, slots, vents, or the like for allowing airflow through the container 800. In some embodiments, the second portion 804 may be weighted so as to minimize the likelihood of the container 800 tipping over. The first portion 802 may be secured to the second portion 804 via a friction fit, magnet, screw threads, or other means.

Figure 9B:
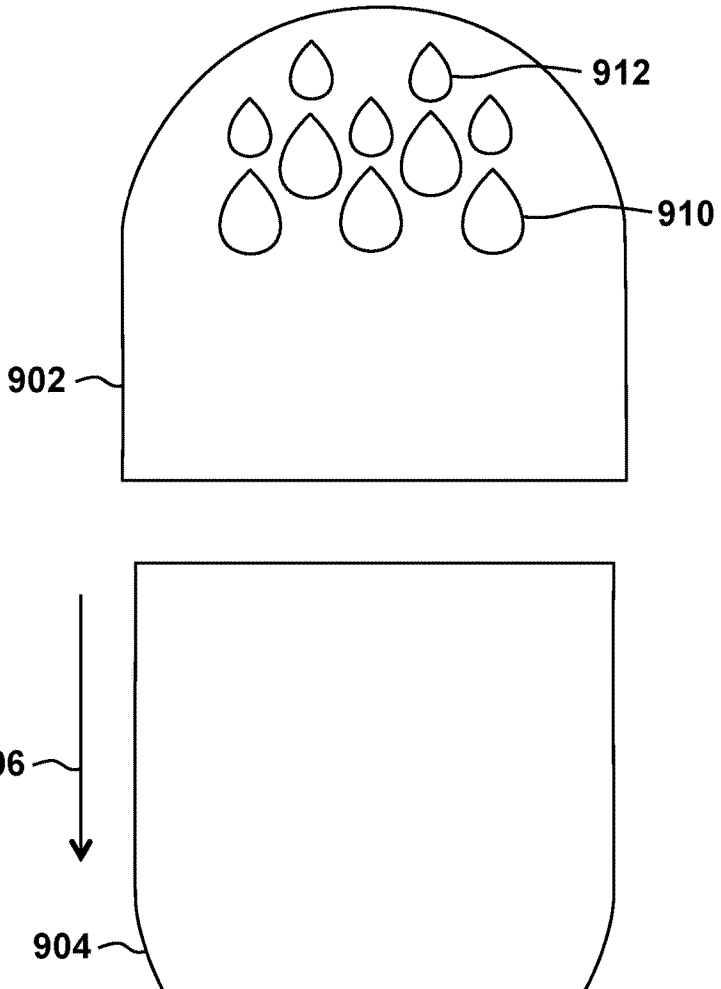
FIG. 9B depicts an exploded view of the alternate container of FIG. 9A, according to one embodiment.
Figure 9A:
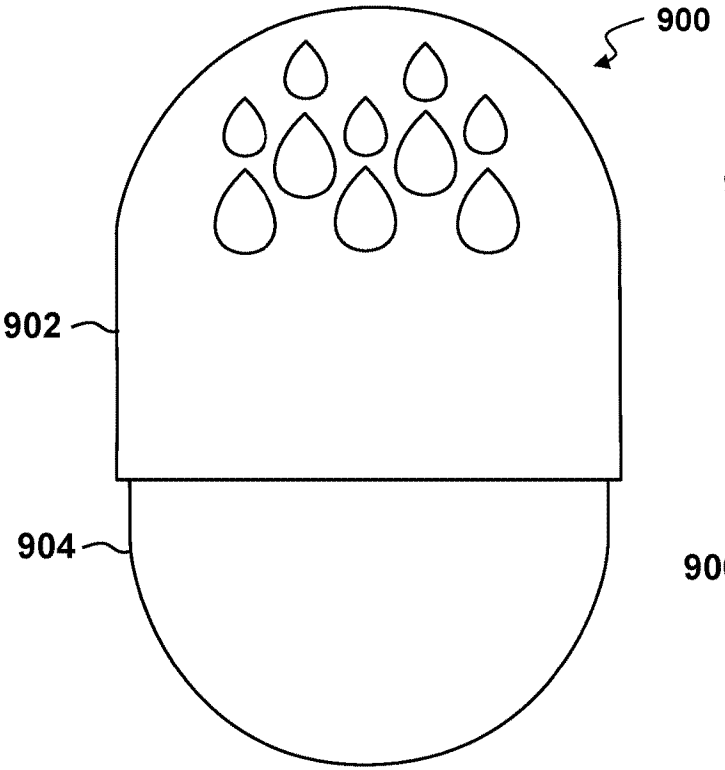
FIG. 9A depicts an alternate container having a first portion with one or more vents and a second portion with no vents, according to one embodiment.

FIG. 9A depicts an alternate container 900 having a first portion 902 with one or more vents 912, 910 and a second portion 904 with no vents, according to one embodiment. FIG. 9B depicts an exploded view of the alternate container 900 of FIG. 9A, according to one embodiment. In some embodiments, only one of the two portions 902, 904 may include vents 910, 912 for airflow to dry a dampened cosmetic sponge disposed within the container 900.

Figure 10:
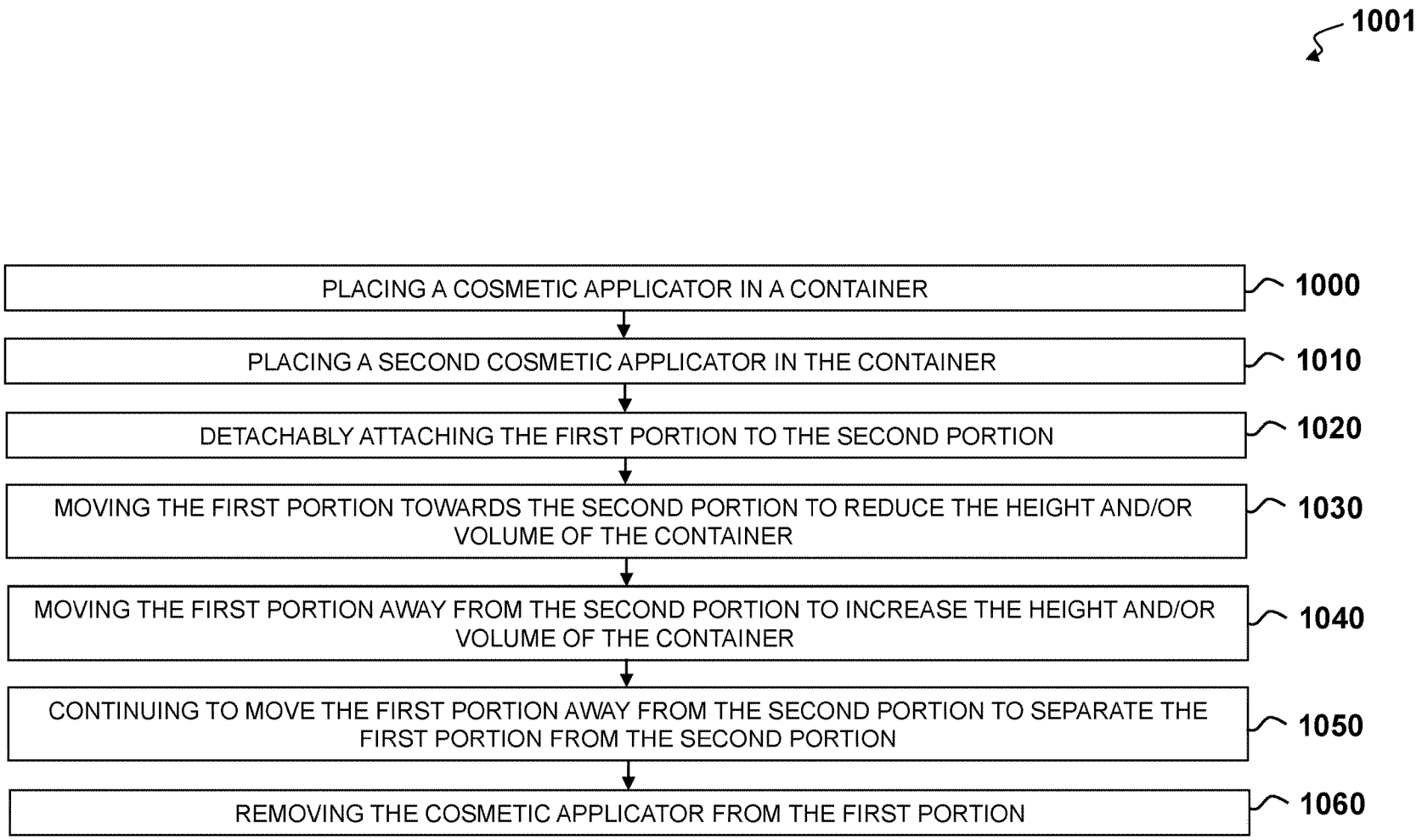
FIG. 10 depicts a high-level flowchart of a method embodiment of using the container, according to one embodiment.

FIG. 10 depicts a high-level flowchart of a method embodiment 1001 of using the container, according to one embodiment. The method embodiment 1001 may include the steps of: placing a cosmetic applicator in a container (step 1000). The container may have a first portion with an open end and a closed end and a second portion with an open end and a closed end. Optionally, the method 1001 may include placing a second cosmetic applicator in the container (step 1010). The method 1001 may also include detachably attaching the first portion to the second portion (step 1020). An outer diameter of the open end of the first portion may have a diameter, if a rounded dome shape, that may be substantially similar to the inner diameter of the open end of the second portion. The method 1001 may then include moving the first portion towards the second portion to reduce the height and/or volume of the container (step 1030). The method 1001 may then include moving the first portion away from the second portion to increase the height and/or volume of the container (step 1040). The method 1001 may then include continuing to move the first portion away from the second portion to separate the first portion from the second portion (step 1050). The method 1001 may then include removing the cosmetic applicator from the first portion (step 1060). In some embodiments, the method 1001 may also include removing the second cosmetic applicator from the second portion.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention is herein disclosed by way of examples and should not be limited by the particular disclosed embodiments described above.

What is claimed is:

1. A container comprising:

a first portion comprising an open end, a closed end, and a middle section, wherein the open end is disposed distal from the closed end, wherein the closed end has a rounded shape, wherein the middle section is disposed between the open end and the closed end, and wherein the middle section has a constant cross-section;

one or more first portion apertures disposed in the first portion proximate the closed end to allow airflow into the container;

a second portion comprising an open end, a closed end, and a middle section, wherein the open end is disposed distal from the closed end, wherein the closed end has a rounded shape, wherein the middle section is disposed between the open end and the closed end, and wherein the middle section has a constant cross-section; and one or more second portion apertures disposed in the second portion proximate the closed end to allow airflow into the container;

wherein an outer diameter of the open end of the second portion is substantially the same as an inner diameter of the open end of the first portion, thereby providing a tight fit;

wherein an outer surface of the middle section of the second portion is slidably secured to an inner surface of the middle section of the first portion via a friction fit, and the middle section of the first portion and the middle section of the second portion have a same height;

wherein the first portion and the second portion are made of flexible material and configured to be detachably attached via squeezing the flexible material to reduce friction while detaching and attaching the first portion from the second portion; and wherein, when attached, the first portion and the second portion slidably move based on the friction fit, thereby changing the container from a first closed position to a second closed position, adjusting the overall height based on the outer surface of the middle section of the second portion being slidably received by the inner surface of the middle section of the first portion and variably changing an interior volume of the container to increase or decrease and storing only one sponge in the first closed position and storing two or more sponges in the second closed position.

2. The container of claim 1, wherein while detachably attached, moving the first portion apart from the second portion in an opposite direction increases an overall height of the container.

3. The container of claim 2, wherein while detachably attached, moving the first portion towards the second portion decreases an overall height of the container.

4. The container of claim 3, wherein the height of the container is adjustable based on a length of at least one of: the middle section of the first portion and the middle section of the second portion.

5. The container of claim 3, wherein the height of the container is adjustable based on the friction fit between the middle section of the first portion and the middle section of the second portion.

6. The container of claim 1, wherein moving the first portion apart from the second portion increases an overall volume of the container to place the container in the second closed position.

7. The container of claim 6, wherein moving the first portion towards the second portion decreases an overall volume of the container to place the container in the first closed position.

8. The container of claim 7, wherein the volume of the container is adjustable based on a length of at least one of: the middle section of the first portion and the middle section of the second portion.

9. The container of claim 1, wherein the container is sized to fit one or more dampened cosmetic sponges based on whether the container is placed in the first closed position or the second closed position.

10. The container of claim 1, wherein the one or more first portion apertures further comprise:

one or more larger sized apertures; and one or more smaller sized apertures;

wherein the larger sized apertures are disposed at a farther distance from the closed end of the first portion than the smaller sized apertures.

11. The container of claim 1, wherein the first portion is configured to be attached to the second portion to form a shape of the container which corresponds to a shape of a capsule with adjustable sides.

12. The container of claim 1, wherein the container in the first closed position has an interior volume less than when in the second close position by approximately one third of the overall volume.

13. The container of claim 12, wherein the container in the second closed position has an interior volume of approximately one third more than the interior volume in the first closed position to fit two cosmetic sponges.

14. The container of claim 1, wherein the cosmetic sponge is a dampened cosmetic sponge stored in the container to dry in the first closed position.

15. The container of claim 14, wherein the first portion and the second portion are configured to each fit one or more dampened cosmetic sponges thereby fitting two or more dampened cosmetic sponges in the container in the second closed position.

16. A container comprising:

a first portion comprising an open end and a closed end, wherein the open end is disposed distal from the closed end;

one or more first portion apertures disposed in the first portion to allow airflow into the container;

a second portion comprising an open end and a closed end, wherein the open end is disposed distal from the closed end; and one or more second portion apertures disposed in the second portion to allow airflow into the container;

wherein a portion of an outer surface of the second portion is received by a portion of an inner surface of the first portion;

wherein the first portion is detachably attached to the second portion; and wherein the first portion and the second portion are made of flexible material and configured to be detachably attached via squeezing the flexible material to reduce friction while detaching and attaching the first portion from the second portion, wherein, when attached, the first portion and the second portion slidably move based on the friction fit, thereby changing the container from a first closed position to a second closed position, adjusting the overall height based on the outer surface of the second portion being slidably received by the inner surface of the first portion and variably changing an interior volume of the container to increase or decrease storing only one sponge in the first closed position and storing two or more sponges in the second closed position.

17. The container of claim 16, wherein the closed end of the first portion has a rounded shape, and wherein the closed end of the second portion has a rounded shape.

18. The container of claim 16, wherein an outer diameter of the open end of the second portion is substantially the same as an inner diameter of the open end of the first portion.

19. The container of claim 16, wherein the first portion comprises a middle section having a substantially constant cross-section, and wherein the second portion comprises a middle section having a substantially constant cross-section.

20. The container of claim 16, wherein the first portion is detachably attached to the second portion by at least one of: a friction fit, one or more screw threads, one or more magnets, and one or more magnetic metals.

* * * * *